US010210983B2

(12) United States Patent
Pradhan et al.

(10) Patent No.: US 10,210,983 B2
(45) Date of Patent: Feb. 19, 2019

(54) ELECTROMAGNETIC INDUCTION DEVICE

(71) Applicant: ABB Schweiz AG, Baden (CH)

(72) Inventors: Manoj Pradhan, Bålsta (SE); Gunnar Russberg, Västerås (SE)

(73) Assignee: ABB Schweiz AG, Baden (CH)

( * ) Notice: Subject to any disclaimer, the term of this patent is extended or adjusted under 35 U.S.C. 154(b) by 103 days.

(21) Appl. No.: 15/169,145

(22) Filed: May 31, 2016

(65) Prior Publication Data

US 2016/0372248 A1 Dec. 22, 2016

Related U.S. Application Data

(60) Provisional application No. 62/180,669, filed on Jun. 17, 2015.

(51) Int. Cl.

| | |
|---|---|
| ***H01F 27/02*** | (2006.01) |
| ***H01F 27/24*** | (2006.01) |
| ***H01F 3/10*** | (2006.01) |
| ***H01F 27/34*** | (2006.01) |
| *H01F 3/14* | (2006.01) |

(52) U.S. Cl.

CPC ..... *H01F 27/02* (2013.01); *H01F 3/10* (2013.01); *H01F 27/346* (2013.01); *H01F 3/14* (2013.01); *H01F 2003/103* (2013.01)

(58) Field of Classification Search

CPC ..... H01F 27/02; H01F 27/346; H01F 27/24; H01F 3/12; H01F 3/10; H01F 3/14; H01F 2003/103; H01F 2003/005

USPC ..... 336/83, 212, 170, 184, 214, 215, 110, 336/160, 165, 218

See application file for complete search history.

(56) References Cited

U.S. PATENT DOCUMENTS

| | | | | |
|---|---|---|---|---|
| 2,909,742 A * | 10/1959 | Lamberton | H01F 27/25 | 336/210 |
| 4,675,615 A * | 6/1987 | Bramanti | G01R 33/04 | 324/253 |
| 5,410,289 A * | 4/1995 | Futa | H01F 5/00 | 335/289 |
| 2002/0180525 A1* | 12/2002 | Lin | H03G 11/02 | 330/207 P |

(Continued)

FOREIGN PATENT DOCUMENTS

| | | |
|---|---|---|
| CN | 1433033 A | 7/2003 |
| CN | 101479817 A | 7/2009 |

(Continued)

OTHER PUBLICATIONS

Chinese Office Action and Translation Application No. 2016104299990 dated Aug. 18, 2017 11 pages.

(Continued)

*Primary Examiner* — Mang Tin Bik Lian
(74) *Attorney, Agent, or Firm* — Whitmyer IP Group LLC

(57) ABSTRACT

An electromagnetic induction device including a magnetic core having a limb which has a first end and a second end, windings arranged around the limb, and a housing including magnetic material, which housing defines a space in which the magnetic core and the windings are arranged, wherein the housing defines a return path for the primary magnetic flux, enabling primary magnetic flux from the first end of the limb to flow via the housing to the second end of the limb.

15 Claims, 3 Drawing Sheets

(56) References Cited

U.S. PATENT DOCUMENTS

| | | | | |
|---|---|---|---|---|
| 2004/0085173 | A1* | 5/2004 | Decristofaro | H01F 27/245 336/178 |
| 2004/0086708 | A1 | 5/2004 | Verma et al. | |
| 2008/0001693 | A1* | 1/2008 | Hahn | H01F 3/12 336/83 |
| 2011/0080246 | A1* | 4/2011 | Chen | H01F 3/12 336/212 |
| 2012/0068805 | A1* | 3/2012 | Levin | H01F 17/04 336/212 |
| 2014/0218157 | A1 | 8/2014 | Liu et al. | |
| 2016/0012954 | A1* | 1/2016 | Noda | H01F 27/255 320/162 |

FOREIGN PATENT DOCUMENTS

| | | | |
|---|---|---|---|
| CN | 201893215 | U | 7/2011 |
| CN | 201918240 | U | 8/2011 |
| CN | 102947904 | A | 2/2013 |
| CN | 202940107 | U | 5/2013 |
| CN | 203366930 | U | 12/2013 |
| CN | 103489582 | A | 1/2014 |
| CN | 104425100 | A | 3/2015 |
| JP | 2005260130 | A | 9/2005 |
| TW | 433178 | B | 4/2014 |
| WO | 2010109272 | A2 | 9/2010 |
| WO | 2015008969 | A | 1/2015 |

OTHER PUBLICATIONS

Cobalt Facts published by the Cobalt Development Institute (CDI) in 2006 and Sun, N.X.; Wang, S.X., "Soft high saturation magnetization (Fe0.7Co0.3)1-xNx thin films for inductive write heads," Magnetics, IEEE Transactions on , vol. 36, No. 5, pp. 2506,2508, Sep. 2000.

Chinese Office Action (w/ translation) Application No. 2016104299990 dated May 3, 2018 9 pages.

* cited by examiner

ELECTROMAGNETIC INDUCTION DEVICE

TECHNICAL FIELD

The present disclosure generally relates to electromagnetic induction devices such as transformers and reactors.

BACKGROUND

An electromagnetic induction device, such as a transformer or a reactor, has a magnetic circuit, the magnetic core, typically made of laminated iron of grain oriented steel or ribbons of amorphous steel, and an electrical circuit, windings, usually made of aluminium or copper wire. A third component, the housing or tank, is necessary in case of fluid filled electromagnetic devices.

The magnetic core comprises one or more limbs. The number of limbs depends on the number of electrical phases to be connected to the electromagnetic induction device. Windings are arranged around each limb.

Varying current in the windings create a magnetic flux in the magnetic core. The magnetic flux in the magnetic core is the primary magnetic flux. Magnetic flux may also be created in other components of an electromagnetic induction device. The windings, for example, may create a magnetic flux, called the leakage flux or leakage magnetic flux, which produces non-desirable losses while passing through the side walls. Such devices typically comprise magnetic shunts, which are metal plates arranged between the windings and the side walls of the housing to reduce the losses.

In the event of more than one limb, the magnetic circuit also comprises yokes, namely an upper yoke and a lower yoke. The yokes mechanically connect the limbs at their ends. A return path which enables circulation of the primary magnetic flux in the magnetic core is thereby obtained.

For large electromagnetic induction devices, such as high voltage rated power transformer, the magnetic circuit may comprise side limbs to reduce the yoke dimension to thereby reduce the overall height dimension of the electromagnetic induction device. Due to transport limitations, e.g. bridge heights, this may be essential to be able to transport an electromagnetic induction device to the site of installation.

SUMMARY

In view of the above, an object of the present disclosure is to provide an electromagnetic induction device which has smaller dimensions than correspondingly rated existing electromagnetic induction device.

There is hence provided an electromagnetic induction device comprising a magnetic core having a limb which has a first end and a second end, windings arranged around the limb, and a housing comprising magnetic material, which housing defines a space in which the magnetic core and the windings are arranged, wherein the housing defines a return path for the primary magnetic flux, enabling primary magnetic flux from the first end of the limb to flow via the housing to the second end of the limb.

The housing hence forms a primary part of the magnetic circuit which also includes the magnetic core. Since the housing defines the return path for the primary magnetic flux, it is not necessary to provide a traditional yoke or a magnetic shunt. These components may in a sense be seen to be integrated in the housing. Since these components may be omitted, the housing can be made smaller. Thereby, transportation to the site of installation may be facilitated, especially for large electromagnetic induction devices. Furthermore, for the same reasons the weight of the electromagnetic induction device may be reduced.

Additionally, the total loss density can be reduced because the total loss density is inversely proportional to the area, which is larger for the housing acting as part of the magnetic circuit, than for a yoke and/or side limbs of traditional designs.

One embodiment comprises a flux density reducer arranged between the first end of the limb and the housing, which flux density reducer has a cross sectional dimension greater than a largest cross sectional dimension of the limb. By means of a flux density reducer, the magnetic flux may be distributed over a larger area. The magnetic flux density can thereby be reduced to a level which is below that which could provide saturation of the housing when the primary magnetic flux propagates into the housing.

According to one embodiment the cross sectional dimension of the flux density reducer is at least the square root of two times the largest cross sectional dimension of the limb. Thereby, the magnetic flux density may be reduced to at least half of the amount of that in the limb midpoint.

According to one embodiment the flux density reducer is a polymer magnet or comprises iron dust, or a composite made of compressible iron powder which has a compaction pressure threshold in the range 60-200 ksi and powder having a permeability above 1000.

According to one embodiment the limb has a cross section which increases towards the first end such that it is at least the square root of two times a cross sectional dimension of the limb at the midpoint of the limb in the axial direction. This could be an alternative, or an addition, to the flux density reducer, to reduce the magnetic flux density before the magnetic flux propagates into the housing.

According to one embodiment the magnetic core comprises a plurality of limbs, and wherein the housing defines an upper yoke and a lower yoke which enable the primary magnetic flux to circulate between the limbs.

According to one embodiment the housing has a top part and a bottom part which are made of silicon steel comprising silicon in the range 3-6% by mass.

According to one embodiment the housing has a side wall made of silicon steel comprising silicon in the range 3-6% by mass, more advantageously 6% or comprises amorphous material or even combination thereof According to one embodiment the housing is made of glued silicon steel lamination or glued amorphous ribbons.

According to one embodiment the housing is made of carbon steel.

According to one embodiment the housing has a top part and a bottom part, wherein the top part and the bottom part have a grain-oriented structure, wherein grain orientation of the top part and the bottom part is along magnetic flux lines of the return path.

According to one embodiment the housing has circular cross section along essentially its entire extension in the axial direction of the limb. By means of this design, the magnetic flux density of the primary magnetic flux may be spread essentially evenly in the housing.

According to one embodiment the housing has elliptical cross section along essentially its entire extension in the axial direction of the limb. In a similar manner, in case the magnetic core is not rotationally symmetric e.g. if the magnetic core comprises several limbs, the magnetic flux density of the primary magnetic flux may be spread essentially evenly in the housing.

According to one embodiment the electromagnetic induction device is a transformer or a reactor.

According to one embodiment the electromagnetic induction device is a high voltage electromagnetic induction device.

According to one embodiment the tank has a side wall provided with a cut extending from a top part of the tank to a bottom part of the tank.

According to one embodiment the side wall comprises a plurality of concentrically arranged sheets, wherein each sheet is provided with the cut.

According to one embodiment each sheet comprises one grain-oriented steel, non-grain oriented steel, and amorphous steel.

Generally, all terms used in the claims are to be interpreted according to their ordinary meaning in the technical field, unless explicitly defined otherwise herein. All references to "a/an/the element, apparatus, component, means, etc. are to be interpreted openly as referring to at least one instance of the element, apparatus, component, means, etc., unless explicitly stated otherwise.

BRIEF DESCRIPTION OF THE DRAWINGS

The specific embodiments of the inventive concept will now be described, by way of example, with reference to the accompanying drawings, in which.

DETAILED DESCRIPTION

The inventive concept will now be described more fully hereinafter with reference to the accompanying drawings, in which exemplifying embodiments are shown. The inventive concept may, however, be embodied in many different forms and should not be construed as limited to the embodiments set forth herein; rather, these embodiments are provided by way of example so that this disclosure will be thorough and complete, and will fully convey the scope of the inventive concept to those skilled in the art. Like numbers refer to like elements throughout the description.

Figure 1:
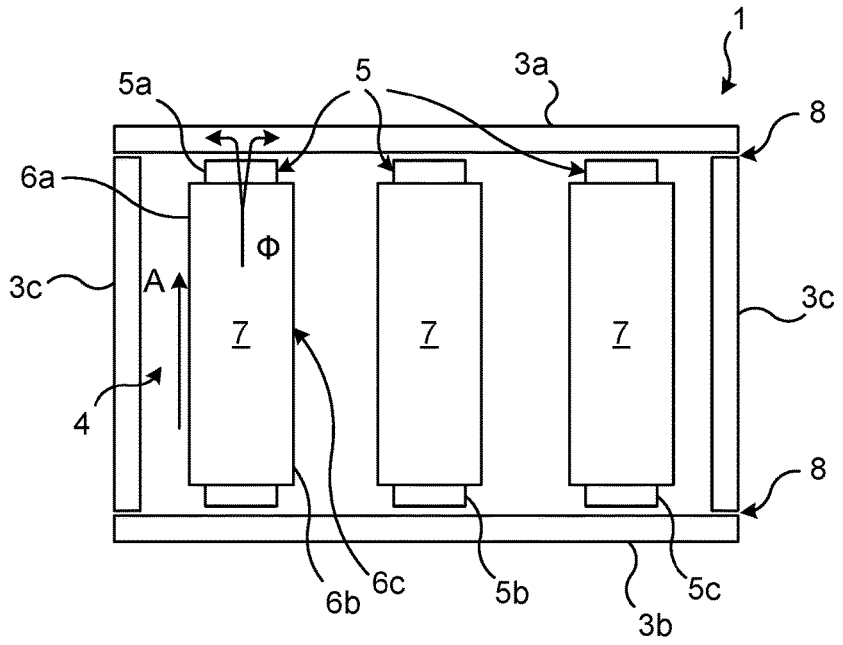
FIG. 1 shows a side view of an electromagnetic induction device with a side wall removed to expose the interior.

FIG. 1 depicts an example of an electromagnetic induction device 1. The electromagnetic induction device 1 comprises a housing or tank 3 comprising magnetic material and which defines a space 4, and a magnetic core 5 and windings 7 arranged in the space 4.

The magnetic core 5 comprises limbs 5*a*-5*c* around which the windings 7 are arranged. It should however be noted that an electromagnetic induction device according to the present disclosure could comprise anywhere from only one limb to a plurality of limbs, for example three as depicted in FIG. 1.

The magnetic core 5 is typically made of laminated magnetic material. The magnetic core 5 may for example be made of silicon steel, comprising for example 3-6% silicon by mass. In case the magnetic core is made of silicon steel, it may for example be grain oriented or non-grain oriented. According to one variation, the magnetic core/limb can be made of glued grain oriented silicon steel laminations or amorphous ribbons or nano-crystalline materials to form a solid body.

Other materials than silicon steel are of course also envisaged, for example other soft iron.

Each limb 5*a-c* has a first end 6*a* and a second end 6*b*. Each limb 5*a*-5*c* thus has a longitudinal body which extends between the first end 6*a* and the second end 6*b*. Each limb 5*a*-5*c* furthermore has a midpoint 6*c*, as seen in the axial direction or longitudinal direction, or axial direction, of a limb 5*a*-5*c*, indicated in FIG. 1 by arrow A.

Each limb 5*a*-5*c* may for example have a circular cross-section; each limb 5*a*-5*c* may for example be a cylindrical elongated member. It may further be noted that each limb 5*a*-5*c* is generally a distinct part, i.e. each limb is a mechanically separate part or entity. The magnetic core 5 may hence be made of one or more mechanically separate parts, i.e. limbs. The magnetic core does not comprise a yoke; instead the tank forms the yoke as well as the remainder of the return path, as will be understood from the following.

The housing 3 has a top part 3*a* which defines a lid or top cover of the housing 3. The housing 3 also has a bottom part 3*b* which defines a lid, bottom cover or floor structure of the housing 3. Furthermore, the housing 3 has one or more sidewalls 3*c* extending between the top part 3*a* and the bottom part 3*b*. To this end, the top part 3*a*, the bottom part 3*b* and the side wall(s) 3*c* define the housing 3 and the space 4.

The housing 3 defines a return path for the primary magnetic flux from the limbs 5*a*-5*c*. To this end, the housing 3 forms part of a magnetic circuit that includes the magnetic core 5. In particular, the housing 3 defines a return path for the primary magnetic flux $\phi$ from the first end 6*a* to the second end 6*b* of each limb 5*a*-5*c*. The top part 3*a* and the bottom part 3*b* thus act as return path for the primary magnetic flux. It may therefore not be necessary to include additional magnetic circuit components such as a yoke, side limbs and/or a magnetic shunt.

Furthermore, depending on the type of the magnetic core, e.g. the number of limbs, the side wall or side walls 3*c* may also form part of the return path. For example, if the electromagnetic induction device 1 has a magnetic core which comprises only one limb, the side wall(s) 3*c* would act as part of the return path. The side wall(s) could also be used as return path in case there is more than one limb. The material of the side wall(s) 3*c* may be selected depending on whether the side wall(s) 3*c* forms part of the return path for the primary magnetic flux $\phi$. The housing 3 defines an upper yoke and a lower yoke of the magnetic circuit which includes the magnetic core 5, and the side walls define the remainder of the return path. Primary magnetic flux $\phi$ is thereby able to circulate through the limbs 5*a*-5*c* and the housing 3.

The housing or tank 3 may be made of a number of different materials. According to one example the entire housing 3 could be made of carbon steel, i.e. construction steel or mild steel. Alternatively, only the side wall(s) 3*c* could be made of carbon steel, for example in applications when the side wall(s) 3*c* is not used as a return path.

According to one variation the housing 3 may be made of silicon steel comprising silicon in the range 3-6% by mass, more advantageously 6%.

According to one variation, the side wall(s) 3*c* may be made of or comprise amorphous material. The amorphous material may for example comprise a plurality of laminated amorphous tapes or ribbons, built from for example tapes of the type disclosed in WO2010109272. Alternatively, the side wall(s) 3*c* may comprise a combination of silicon steel and amorphous material. According to one variation, the side wall(s) 3*c* may comprise, or be made of, non-grain oriented material.

According to one variation, the side wall(s) 3*c* may be made of a plurality of concentrically arranged sheets. The concentrically arranged sheets may for example be arranged in direct contact with each other, they may be glued to each other or there may be provided an air gap between each of or some of the sheets. Each sheet may for example consist of one of an amorphous material, grain-oriented steel or non-grain oriented steel. The sheets may either be of the same material type, or they could be of different material types, e.g. a first subset of the sheets may be made of amorphous steel, a second subset of the sheets may be made of a grain-oriented steel, and a third subset of the sheets may be made of a non-grain oriented steel, or each or some of the sheets may be made of a combination of these material. The particular configuration may be selected when designing the electromagnetic induction device, depending on the performance requirements for a specific application. In case a plurality of concentrically arranged sheets consisting of any of the above suggested materials is used, the size of the tank may be reduced, as the maximum flux density of the side wall(s) 3*c* will be higher than for a construction steel tank of the same size, which has a lower maximum flux density. On the other hand, a tank utilising construction steel instead of the concentrically arranged sheets is simpler to manufacture.

Materials with better magnetic properties may advantageously be used for the top part 3*a* and the bottom part 3*b*. According to one variation, the top part 3*a* and the bottom part 3*b* may be made of silicon steel, comprising silicon in the range 3-6% by mass. The top part 3*a* and the bottom part 3*b* may according to one variation be made of glued discs to form a stronger solid body.

According to one variation, the electromagnetic induction device 1 has joints 8 between the side wall(s) 3*c* and the top part 3*a* and the side wall(s) 3*c* and the bottom part 3*b*. The joints 8 may be filled with a magnetic material. Thereby losses related to the primary magnetic flux along the return path defined by the housing 3 may be reduced. The joints 8 may for example be filled with iron dust, a polymer magnet, or ferrofluid or a combination of these components.

The gap between the top part 3*a* of the housing 3 and the first end 6*a* of the limb 5*a*-5*c* is according to one variation very small, for example 1 mm or 0.2 mm or less. This gap may for example be filled with air or a ferrofluid.

The gap between the bottom part 3*b* of the housing 3 and the second end 6*b* of the limb 5*a*-5*c* is according to one variation very small, for example 1 mm or 0.2 mm or less. This gap may for example be filled with air or a ferrofluid.

Figure 2A:
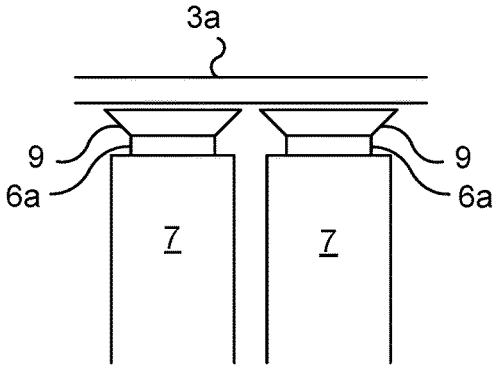
FIGS. 2*a-b* depicts close-up views of examples of limbs and housing top part.

Referring to FIG. 2*a*, according to one variation the electromagnetic induction device 1 may optionally comprise flux density reducers 9. A respective flux density reducer 9 is in this case arranged between the first end 6*a* of each limb 5*a*-*c* and the top part 3*a* of the housing 3.

The electromagnetic induction device 1 may optionally comprise a respective flux density reducer 9, not shown in the drawings, arranged between the second end 6*b* of each limb 3*a*-*c* and the bottom part 3*b* of the housing 3.

The flux density reducers 9 are adapted to reduce the magnetic flux density of the primary magnetic flux $\phi$ as it propagates from a limb 5*a*-*c* to the housing 3. The magnetic flux density can thereby be reduced such that the housing 3 will not be saturated, which would result in large eddy current generation and high losses.

Each flux density reducer 9 may have a tapering shape. Each flux density reducer 9 is tapering in a direction from the housing towards the associated limb 5*a*-5*c*. To this end, the proximal end of a flux density reducer 9, i.e. the end which is adjacent to the limb 5*a*-5*c*, has a smaller cross sectional dimension than the distal end of the flux density reducer 9 relative to the same limb 5*a*-*c*. The tapering is preferably continuous, or at least in very small discrete steps, obtained e.g. by means of a plurality of laminated tapes of successively smaller dimension towards the limb 5*a*-5*c*.

Each flux density reducer 9 may for example be a polymer magnet or each flux density reducer 9 may comprise iron dust. Alternatively, each flux density reducer 9 may comprise a compressible composite made of compressible iron dust and high permeability powder, as disclosed in US2004/0086708, e.g. or a composite made of compressible iron powder which has a compaction pressure threshold in the range 60-200 ksi and powder having a permeability above 100 000. Alternatively, each flex density reducer 9 may be made of high saturation Fe—Co or FeCoN as disclosed in Cobalt Facts published by the Cobalt Development Institute (CD) in 2006 and Sun, N. X.; Wang, S. X., "Soft high saturation magnetization (Fe0.7Co0.3)1-xNx thin films for inductive write heads," Magnetics, IEEE Transactions on, vol. 36, no. 5, pp. 2506, 2508, September 2000.

According to one variation, each flux density reducer may comprise a different material than any of the other flux density reducers 9.

By suitably dimensioning the cross sectional area of the flux density reducers 9, the magnetic flux density may be reduced substantially. The magnetic flux density is halved, assuming a circular cross section, when the diameter of the material in which the magnetic flux propagates is increased with a factor of square root of two. Thus, by suitable dimensioning of the flux density reducer 9, the magnetic flux density of the primary magnetic flux $\phi$ may be reduced to half or even one fourth of the magnetic flux density which exists in the midpoint 6*c* of the limb 3*a*-*c*.

In general, the flux density reducer 9 may have a cross sectional dimension greater than a largest cross sectional dimension of the limb 5*a*-5*c*. The cross sectional dimension of the flux density reducer 9 may for example be at least the square root of two times the largest cross sectional dimension of the limb 5*a*-5*c*.

Figure 2B:
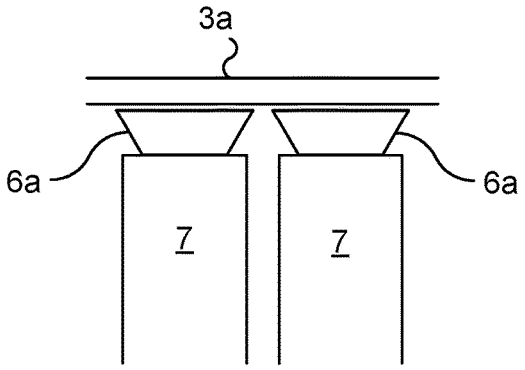

FIG. 2*b* depicts a variation of the electromagnetic induction device 1 where the ends of each limb 5*a*-5*c*, i.e. the first end 6*a* and the second end 6*b*, increase in dimension in a direction towards the top part 3*a* and bottom part 3*b*, respectively. Similarly to the flux density reducers 9, the increase in cross sectional dimension reduces the magnetic flux density before it propagates into the housing 3, in particular the top part 3*a* and the bottom part 3*b*. By proper dimensioning of the first end 6*a* and the second end 6*b*, a suitable magnetic flux density may be obtained.

The tapering, which is towards the midpoint 6*c*, of the first end 6*a* and the second end 6*b* is preferably continuous. According to one variation, the tapering is essentially linear in the sense that the reduction in cross sectional dimension is equal for each length unit towards the midpoint 6*c*.

The tapering of a limb 5*a*-5*c* could for example be obtained by inserting additional laminations, for example made of cold rolled grain oriented material, between the main laminations or ribbons of which the limb is made. Alternatively, or additionally, amorphous ribbons or iron dust could be inserted between the main laminations or ribbons of which the limb is made. Thus according to one variation, ribbons or laminations may be inserted between the main laminations at the first end 6*a* and the second end 6*b* of a limb 5*a*-5*c*. In this manner, a successively increasing limb cross section can be achieved in a direction towards the limb end face. The laminations may be inserted between for example every third or fourth main lamination to obtain a desirable widening of the limb. According to one example, several amorphous ribbons may be arranged between a pair of main laminations. The exact number of inserted laminations or ribbons typically depends on the maximum cross section which is to be achieved to obtain a desired magnetic flux density, and on the thickness of the laminations and/or ribbons. The thickness of cold rolled grain oriented material could for example be in the range 0.1 mm to 0.3 mm, while an example of a thickness of the amorphous ribbons is about 0.025 mm.

Alternatively, laminations or ribbons may be arranged in layers and bent outwards with the layers being provided at the external surface of the outermost main laminations, at the end portion of the limb.

In each of the above examples, the bending of the laminations/ribbons will follow the magnetic flux lines.

Figure 3A:
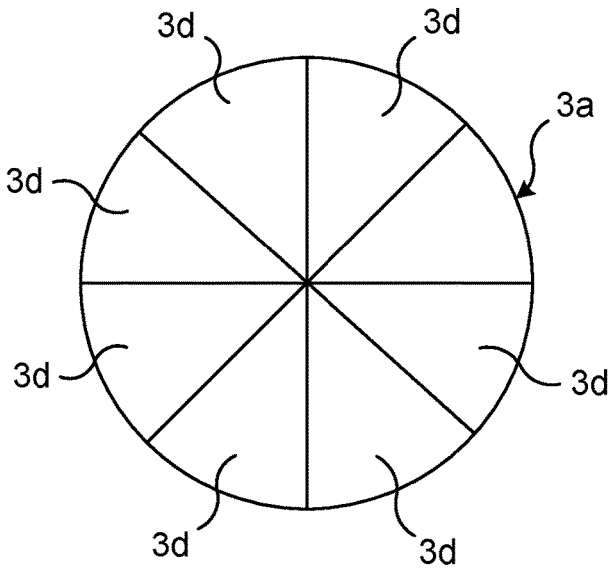
FIGS. 3*a-b* show top views of examples of electromagnetic induction devices.
Figure 3B:
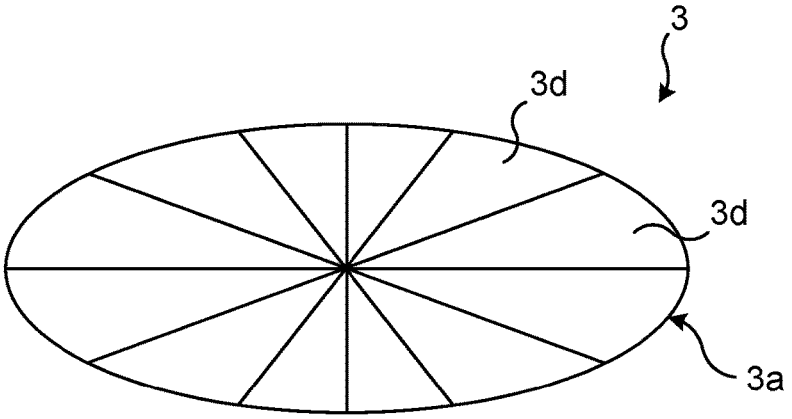

FIGS. 3*a* and 3*b* show examples of shapes of the housing 3. In FIG. 3*a*, the housing has a top part 3*a* which has an essentially circular cross section. The same may apply also to the bottom part 3*b*. According to one variation, the electromagnetic induction device 1 has a cylindrical shape.

According to the example shown in FIG. 3*a* the top part 3*a* may according to one variation comprise a plurality of sub-parts 3*d* which are assembled together and form the top part 3*a*. The bottom part 3*b* may be constructed in a similar manner. According to this example the sub-parts 3*d* have a grain-oriented structure. The grain orientation of the sub-parts 3*d* is along magnetic flux lines of the return path. Thus, the grain orientation essentially follows any radial line from the centre point of the top part 3*a* to the periphery of the top part 3*a*. The same also applies to the bottom part 3*b*.

In the example in FIG. 3*b* the top part 3*a* comprises a plurality of sub-parts 3*d* which are assembled together and form the top part 3*a*. In the present example, the top part 3*a* has an elliptical cross-sectional shape. The bottom part 3*b* may be constructed in a similar manner. According to this example the sub-parts 3*d* have a grain-oriented structure. The grain orientation of the sub-parts 3*d* is along magnetic flux lines of the return path. Thus, the grain orientation essentially follows any straight line from the centre point of the top part 3*a* to the periphery of the top part 3*a*. The same applies also to the bottom part 3*c*. Instead of, or in addition to the grain oriented sub-parts 3*d* of the top part 3*a*, the limb(s) could also be made of a plurality of sub-parts or sections that are grain-oriented, having a cross-section similar to the configuration shown in FIG. 3*a*, as shown in FIG. 4*a*.

In general, the electromagnetic induction device 1 may have any cross sectional shape i.e. in a section taken in a radial plane, for example circular, elliptical, or rectangular. The electromagnetic induction device 1 may have an essentially constant cross sectional shape in the axial direction of the limb(s). It should however be mentioned that the housing may comprise structures such as one or more turrets and/or openings for example to receive one or more bushings. There may hence exist cross sections which have a shape that diverge from the general cross sectional shape of the electromagnetic induction device.

The side wall and/or top part may thus have one or more openings at a suitable location(s), preferably at low flux density zones, for example at the corner(s) of a housing which has rectangular cross section. This opening may be utilised to receive a bushing to take the winding leads out from the electromagnetic induction device.

Figure 4A:
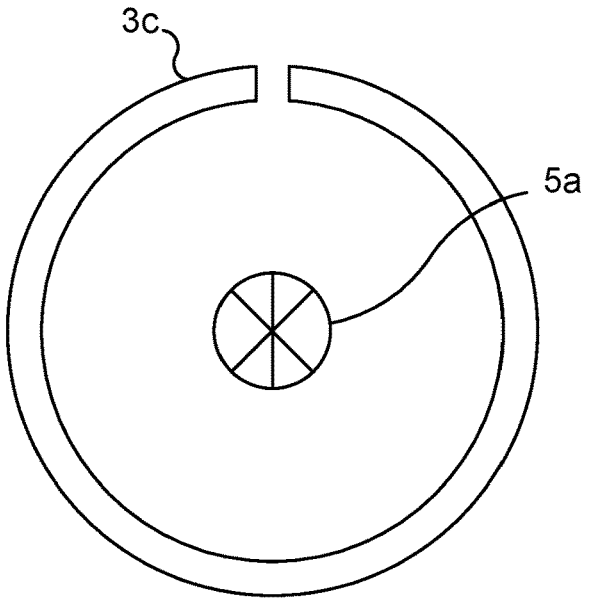
FIG. 4*a* schematically shows a cross-section of an example of an electromagnetic induction device.

FIG. 4*a* schematically shows a cross-section of an example of an electromagnetic induction device. According to this example, the side wall 3*c* is provided with a cut 11 having an extension generally in the longitudinal direction of the electromagnetic induction device 1, extending between the top part 3*a* and the bottom part 3*b* of the housing or tank 3. The cut 11 may for example extend parallel with the longitudinal axis of the housing 3 or tank. The cut 11 is a through-cut, or through-opening, extending from the outer surface of the side wall 3*c* to the inner surface. The longitudinal cut 11 forms a gap for reducing induced currents in the side wall 3*c*. The cut 11 may extend along the entire longitudinal extension of the side wall 3*c*.

Figure 4B:
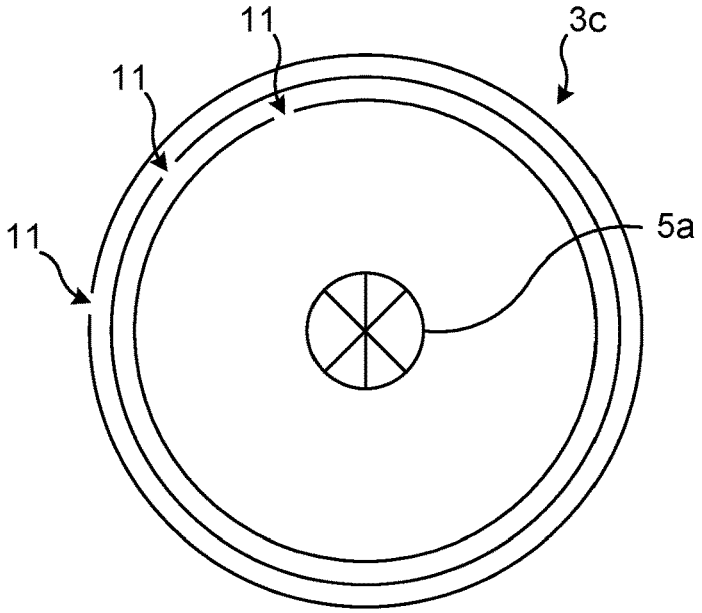
FIG. 4*b* schematically shows a cross-section of another example of an electromagnetic induction device.

The cut 11 may according to one variation be provided in the side wall 3*c* in case the side wall 3*c* is made of or consists of construction steel. According to another variation, the cut may be provided in each of the plurality of concentrically arranged sheets forming the side wall 3*c*, as shown in FIG. 4*b*. In this case, the cuts 11 in the sheets may be radially aligned, or they may be arranged at an angle relative to each other, i.e. the cuts are not aligned in the radial direction, as shown in FIG. 4*b*.

In either of the above cases, the gap defined by the cut may be filled with an insulating material. For fluid-filled tanks/housings, the insulating material is also configured to act as a fluid-tight gasket.

In case a cut 11 is provided in the side wall 3*c*, according to one variation a bushing may be fitted in this cut so that no further through-opening will have to be made in the side wall 3*c* specifically for the bushing. This would provide a smaller impact for the return path of the flux.

The electromagnetic induction device 1 and examples thereof described herein may for example be a transformer e.g. a power transformer or a distribution transformer such as pole-mounted transformer, or a reactor. The electromagnetic induction device may for example be a medium voltage or high voltage electromagnetic induction device. With high voltage are meant voltages starting at 32 kV. The electromagnetic induction device could also be a High Voltage Direct Current (HVDC) electromagnetic induction device, such as a HVDC transformer or reactor.

The inventive concept has mainly been described above with reference to a few examples. However, as is readily appreciated by a person skilled in the art, other embodiments than the ones disclosed above are equally possible within the scope of the inventive concept, as defined by the appended claims.

What is claimed is:

1. An electromagnetic induction device that is a transformer or a reactor, comprising:

a magnetic core having a limb which has a first end and a second end, windings arranged around the limb, a tank comprising magnetic material, the tank having a top part, a bottom part, and a side wall that define a space in which the magnetic core and the windings are arranged, the side wall at least substantially surrounding the magnetic core, and a flux density reducer arranged between the first end of the limb and the tank, the flux density reducer having a cross sectional dimension greater than a largest cross sectional dimension of the limb, the flux density reducer has a tapering shape, wherein the tank provides a return path for a primary magnetic flux which is a magnetic flux in the magnetic core, the primary magnetic flux being configured to flow from the first end of the limb to the second end of the limb via the return path.

2. The electromagnetic induction device as claimed in claim 1, wherein the cross sectional dimension of the flux density reducer is at least the square root of two times the largest cross sectional dimension of the limb.

3. The electromagnetic induction device as claimed in claim 1, wherein the flux density reducer is a polymer magnet or comprises iron dust or a composite made of compressible iron powder which has a compaction pressure threshold in a range 60-200 ksi and powder having a permeability above 1000.

4. The electromagnetic induction device as claimed in claim 1, wherein the limb has a cross section which increases towards the first end such that the first end of the limb is at least the square root of two times a cross sectional dimension of the limb at a midpoint of the limb in an axial direction.

5. The electromagnetic induction device as claimed in claim 1, wherein the magnetic core comprises a plurality of limbs, and wherein the top part and the bottom part of the tank are respectively an upper yoke and a lower yoke which provide circulation of the primary magnetic flux between the limbs.

6. The electromagnetic induction device as claimed in claim 1, wherein the top part and the bottom part are made of silicon steel comprising silicon in a range 3-6% by mass.

7. The electromagnetic induction device as claimed in claim 1, wherein the side wall comprises amorphous material.

8. The electromagnetic induction device as claimed in claim 1, wherein the tank is made of carbon steel.

9. The electromagnetic induction device as claimed in claim 1, wherein the top part and the bottom part have a grain-oriented structure, wherein grain orientation of the top part and the bottom part is along magnetic flux lines of the return path.

10. The electromagnetic induction device as claimed in claim 1, wherein the tank has a circular cross section along an entire extension of the limb in an axial direction of the limb.

11. The electromagnetic induction device as claimed in claim 1, wherein the tank has an elliptical cross section along an entire extension of the limb in an axial direction of the limb.

12. The electromagnetic induction device as claimed in claim 1, wherein the side wall is provided with a cut extending from the top part of the tank to the bottom part of the tank.

13. The electromagnetic induction device as claimed in claim 12, wherein the side wall comprises a plurality of concentrically arranged sheets, wherein each sheet is provided with the cut.

14. The electromagnetic induction device as claimed in claim 13, wherein each sheet comprises one of grain-oriented steel, non-grain oriented steel, or amorphous steel.

15. The electromagnetic induction device as claimed in claim 2, wherein the flux density reducer is a polymer magnet or comprises iron dust, or a composite made of compressible iron powder which has a compaction pressure threshold in a range 60-200 ksi and powder having a permeability above 1000.

* * * * *